US009691369B2

(12) United States Patent
Trifilio

(10) Patent No.: US 9,691,369 B2
(45) Date of Patent: Jun. 27, 2017

(54) ADJUSTABLE GUITAR EFFECTS PEDALBOARD

(71) Applicant: Chemistry Design Werks LLC, St. Paul, MN (US)

(72) Inventor: Christian Richard Trifilio, St. Paul, MN (US)

(73) Assignee: Chemistry Design Werks LLC, St. Paul, MN (US)

( * ) Notice: Subject to any disclaimer, the term of this patent is extended or adjusted under 35 U.S.C. 154(b) by 0 days.

(21) Appl. No.: 15/231,314

(22) Filed: Aug. 8, 2016

(65) Prior Publication Data

US 2017/0098438 A1 Apr. 6, 2017

Related U.S. Application Data

(63) Continuation-in-part of application No. 29/540,570, filed on Oct. 5, 2015, now Pat. No. Des. 769,364.

(60) Provisional application No. 62/248,589, filed on Oct. 30, 2015.

(51) Int. Cl.
*G10H 1/34* (2006.01)
*G10G 5/00* (2006.01)

(52) U.S. Cl.
CPC ..... *G10H 1/348* (2013.01); *G10G 5/00* (2013.01); *G10H 2210/155* (2013.01)

(58) Field of Classification Search
CPC ..... G10D 5/00; G10G 7/00; G10G 7/005
USPC ..... 84/453
See application file for complete search history.

(56) References Cited

U.S. PATENT DOCUMENTS

| | | | |
|---|---|---|---|
| D311,458 | S | 10/1990 | La Croix |
| 6,459,023 | B1 | 10/2002 | Chandler |
| 6,538,185 | B1 | 3/2003 | Stratton |
| D594,564 | S | 6/2009 | Disch et al. |
| D690,708 | S | 10/2013 | Smith et al. |
| D745,923 | S | 12/2015 | Trifilio |
| D745,924 | S | 12/2015 | Trifilio |
| 2003/0230220 | A1 | 12/2003 | Evans et al. |
| 2004/0250673 | A1 | 12/2004 | Salerno |
| 2006/0120550 | A1 | 6/2006 | McCann |
| 2007/0295190 | A1 | 12/2007 | Collins |
| 2011/0271821 | A1 | 11/2011 | McKinney et al. |

OTHER PUBLICATIONS

"My New Pedalboard," Posted at musiciansroadhouse.com, earliest date available Dec. 1, 2015, [online], acquired on Jul. 1, 2016. Available from Internet, <URL: http://musiciansroadhouse.com/viewtopic.php?t=4562&start=300>.

(Continued)

*Primary Examiner* — Kimberly Lockett
(74) *Attorney, Agent, or Firm* — Adams Grumbles, LLP; Brittany Nanzig; Paul Feng

(57) ABSTRACT

An adjustable guitar effects pedalboard for anchoring guitar effects pedals. More specifically, a pedalboard having an upper level and a lower, telescoping level that is configured to allow users to adjust the width of the pedalboard to fit their needs. The upper level and the lower, telescoping level are curved and further contain a plurality of holes on which users can use cable ties to anchor their guitar effects pedals. The lower, telescoping level is comprised of a first telescoping section and a second telescoping section, and the plurality of holes in each of the telescoping sections align with each other in various positions of expansion and contraction.

20 Claims, 9 Drawing Sheets

(56) References Cited

OTHER PUBLICATIONS

"Chemistry Design Werks Holeyboard WIDE Review—Best Guitar Pedalboard?," posted at bestguitareffects.com, earliest date available Aug. 23, 2013, [online], acquired on Jul. 1, 2016. Available from Internet, <URL: http://www.bestguitareffects.com/chemistry-design-werks-holeyboard-wide-review-best-guitar-pedalboard>.
Pedaltrain; Pedal Boards—Pedaltrain; Website; Jul. 27, 2014; http://www.pedaltrain.com/pedalboards.
Trailer Trash Pedalboards; Trailer Trash Pedal Boards: Custom Pedalboards; Website; Feb. 7, 2005; http://trailertrashpedalboards.com.
Rogue Guitar Shop; Pedalboards—Rogue Guitar Shop; Website; Oct. 10, 2014; http://www.rogueguitarshop.com/collections/pedalboards.
Gator Cases, Inc.; Pedal Boards and Stands; Website; Mar. 3, 2012; http://www.gatorcases.com/c/16108/pedal-boards-and-stands.
Blackbird; Blackbird Custom Pedalboards; Website; May 19, 2013; http://blackbirdpedalboards.com.
Fix Pedal Boards; Welcome to FIX Pedalboards; Website; Apr. 21, 2013; http://blackbirdpedalboards.com.
MKS Professional Stage Products, Inc; Pedal Pad Get Serious; Webiste; Apr. 29, 2013; http://www.pedalpad.com.
Phantom Pedalboards; Phantom Pedalboards; Website: Apr. 1, 2015; http://www.phantompedalboards.com/boards/index.
SKB Corporation; Guitar Products; Website: Jun. 3, 2014; https://www.skbcases.com/music/products/prodlist.php?c=85&,s=75.
Renovo AMP Works; Stombox Modular Pedalboards; Website; Jan. 22, 2015; http://www.stompblox.com.
Diago; Diago Hardcase Pedalboards; Website; Apr. 23, 2012; http://www.diago.co.uk/pedalboards/diago-pedalboards.html.
LYT Pedalboards; LYT Pedalboards; Website; Jan. 1, 2012; http://www.lytpedalboards.com.
Llevinac SL; Aclam Guitars; Website; 2015; http://www.aclamguitars.cat/shop/en/landing-page/81-2014guitar.html.
U.S. Appl. No. 29/540,570, filed May 10, 2015.
U.S. Appl. No. 62/248,589, filed Oct. 30, 2015.
Prosecution History from U.S. Appl. No. 29/540,570, dated Jul. 28, 2016 through Jul. 29, 2016, 11 pp.

ADJUSTABLE GUITAR EFFECTS PEDALBOARD

CROSS-REFERENCE TO RELATED APPLICATIONS

The disclosed application is a continuation in part of U.S. application Ser. No. 29/540,570, filed Oct. 5, 2015, which is titled ADJUSTABLE GUITAR PEDALBOARD, and claims the benefit of U.S. Provisional Application No. 62/248,589, filed on Oct. 30, 2015, which is titled ADJUSTABLE GUITAR EFFECTS PEDALBOARD.

FIELD OF THE DISCLOSURE

The disclosed invention relates to an adjustable guitar effects pedalboard. More specifically, the disclosed invention relates to a curved pedalboard having an upper level and a lower, telescoping level that enables users to adjust the width of the pedalboard to fit their needs. The upper and the lower levels further contain holes on which users can anchor their guitar pedals.

BACKGROUND OF THE INVENTION

When playing concerts, musicians often use effects units to alter how a musical instrument sounds. Some units are built into an instrument while others are separate from the instrument. For example, guitar players will often use guitar effects pedals to alter the sound of their electric guitars. While guitar effects pedals provide a musician with additional sounds, they are usually limited to one or two effects. Therefore, guitar players frequently desire access to a plurality of guitar effects pedals during a concert. However, placement of several pedals loose on a performance floor is impractical and can pose risk of damage to, or disconnection of, the various pedals during performance.

To meet the need for convenient use of multiple pedals, a pedalboard is often used. Often times, pedalboards are flat boards to which a user can attach guitar effects pedals through the use of hook and loop fasteners (for example, Velcro). For example, a user can attach the hook side to the pedalboard and the loop side to the guitar effects pedal, or vice versa. This enables a guitar effects pedal to be removed if it is not in use. However, pedals are frequently different sizes, and hook and loop fasteners often leave residue if removed from the pedalboard or guitar effects pedals. Therefore, if a guitar player uses hook and loop fasteners to attach pedals to a pedalboard, it can be difficult to rearrange the layout of pedals.

To overcome this design shortfall, pedalboards have been created that have holes in them. By using a pedalboard with holes, a user can thread a cable tie through two holes and secure the pedal to the pedalboard. Because a cable tie can easily be removed by being cut and because the cable tie will not leave residue on the pedalboard, this type of pedalboard enables a user to easily re-arrange the pedals whenever the user desires. However, one problem that continues to exist is the fixed size of the pedalboard. A guitar player who is a relative novice may want a small pedalboard that holds only a few guitar effects pedals, but may quickly gain skill and desire additional effects pedals. Consequently, the guitar player may need a larger pedalboard. Therefore, that user must purchase another pedalboard. In another example, a user may play different kinds of concerts or different styles of music, wherein several effects pedals are required at some concerts but only a few are required at others. Because of the fixed size of pedalboards, the user must purchase several pedalboards to meet his or her needs. Therefore, a pedalboard is needed that a user can vary in size based on the user's particular performance needs.

SUMMARY OF THE INVENTION

The present disclosure relates to an adjustable guitar effects pedalboard having an upper level and a lower, telescoping level. More specifically, the pedalboard can be curved and can have a plurality of holes in the upper level and the lower level to enable a user to attach effects pedals to the pedalboard. The holes in the plurality of pieces of the lower, telescoping level can line up when the lower, telescoping level is in various positions of expansion and contraction.

DETAILED DESCRIPTION

Figure 1:
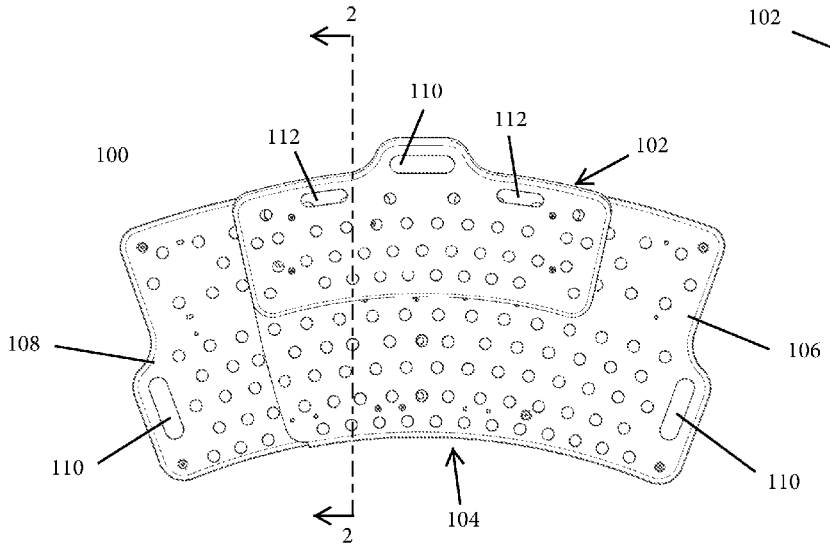
FIG. 1 is a top view of an adjustable guitar effects pedalboard in a partially expanded configuration according to one embodiment of the disclosed device.

The present disclosure relates to an adjustable guitar effects pedalboard 100 that is used as a platform to which a user can attach guitar effects pedals. Various embodiments of the pedalboard 100 will be described in detail with reference to the drawings, wherein like reference numerals represent like parts and assemblies throughout the several views. Reference to various embodiments does not limit the scope of the pedalboard 100 disclosed herein. Additionally, any examples set forth in this specification are not intended to be limiting and merely set forth some of the many possible embodiments for the pedalboard 100. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Figure 4:
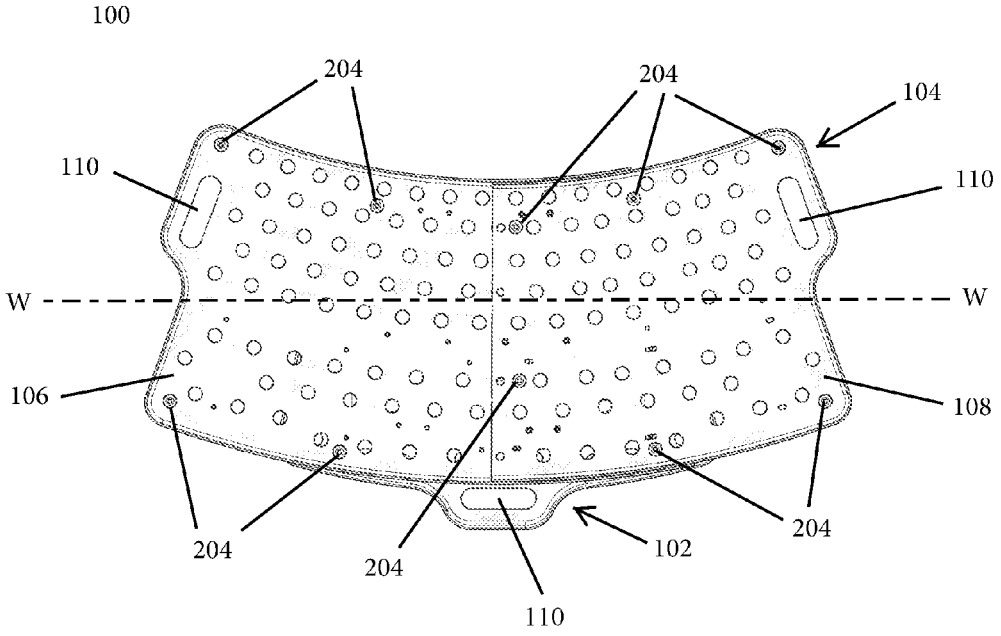
FIG. 4 is a bottom view of the adjustable guitar effects pedalboard of FIG. 1 in a partially expanded configuration according to one embodiment of the disclosed device.

In general terms, the present disclosure relates to an adjustable guitar effects pedalboard 100 used as a platform to which a user can attach guitar effects pedals. Various embodiments of the pedalboard 100 can include a number of components including, but not limited to, an upper level 102 having a plurality of holes and a substantially flat, top mounting surface; a lower, telescoping level 104 having a plurality of holes and a substantially flat, top mounting surface; and at least one riser 202 to lift and secure the upper level 102 on top of the lower level 104. The pedalboard 100 can be approximately 5½ inches tall from the ground to the top of the pedalboard 100, 17 inches long from the front to the back of the pedalboard 100, and each of the levels can be approximately one half of an inch thick. As described further below, the width of the pedalboard 100 may be variable. Additionally, the pedalboard 100 can be made of aluminum, wood, plastic, or any other metal. For example, the upper level 102 and the lower level 104 may be made of aluminum that is 100 to 125 thousandths thick. The plurality of holes in the upper level 102 and the lower level 104 can be circular, as illustrated in FIGS. 1 and 4, or any other shape.

Figure 18:
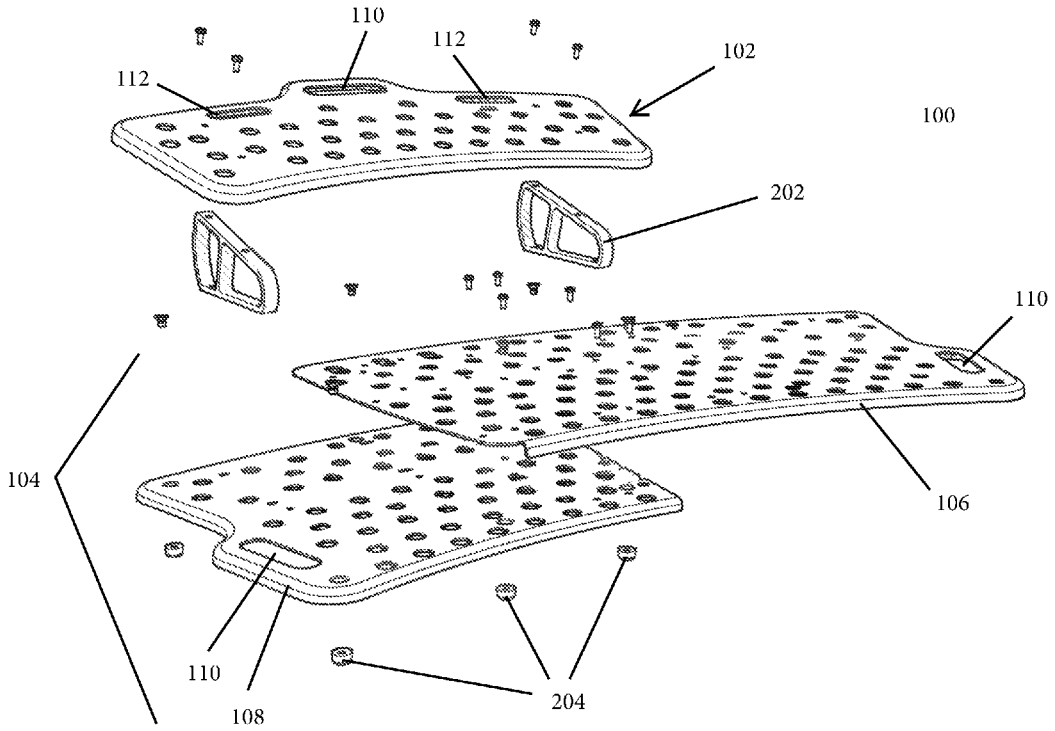
FIG. 18 is an exploded view of an adjustable guitar effects pedalboard according to one embodiment of the disclosed device.

As illustrated in FIG. 18, each of the two components of the lower level 104 has holes throughout the surface through which a user can thread, for example, a cable tie, rubber band, twist tie, or other securing means to secure a guitar effects pedal to the pedalboard 100. More specifically, a user can place a guitar effects pedal between two holes on the pedalboard 100, thread a cable tie through the two holes and around the pedal, and secure the cable tie to itself with the pedal now held firmly in place between the pedalboard 100 and the cable tie. The same process can be implemented on the upper level 102.

Effects pedals do not come in standard sizes and some tend to be much bigger or much smaller than others. When attaching an effects pedal to a pedalboard 100 with holes, it is important for the holes to be located at close locations to, and in various positions around, the effects pedals. The holes on the upper level 102 and lower level 104 are specifically designed for several industry effects pedal types. Additionally, the upper level 102, in some embodiments, can support other guitar accessories attached to the pedalboard 100. Because of the hole pattern disclosed herein, virtually any pedal can be attached securely to the pedalboard 100.

In a preferred embodiment, the upper level 102 is smaller in width and length than the lower level 104 and is located toward the back of the top face, or mounting surface, of the lower level 104, as illustrated in FIG. 1. However, the upper level 102 can be as wide and/or as long as the lower level 104 and may be fixed in its position or may be adjustable and/or removable so that it can attach in various places along the lower level 104. For example, the upper level 102 can attach along the back of the top face of the lower level 104 and on the left, middle, or right sides of the top face of the upper level 102, as illustrated in FIGS. 8-17. In other embodiments, the upper level 102 can attach in the middle of the top face of the lower level 104 or toward the front of the top face of the lower level 104 and on the left, middle, or right sides of the top face of the upper level 102. In a preferred embodiment, the width of the upper level 102 is fixed. However, in some embodiments the upper level 102 may be a telescoping level and, therefore, may vary in width.

Figure 6:
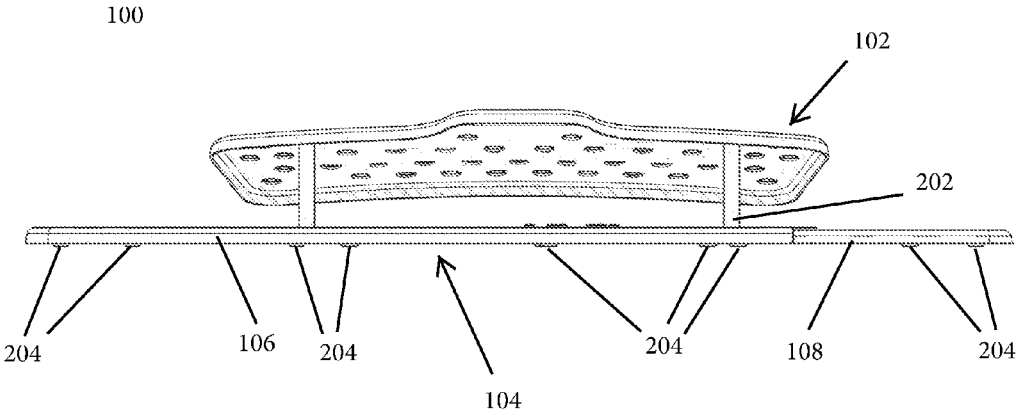
FIG. 6 is a back elevational view of the adjustable guitar effects pedalboard of FIG. 1 in a partially expanded configuration according to one embodiment of the disclosed device.
Figure 9:
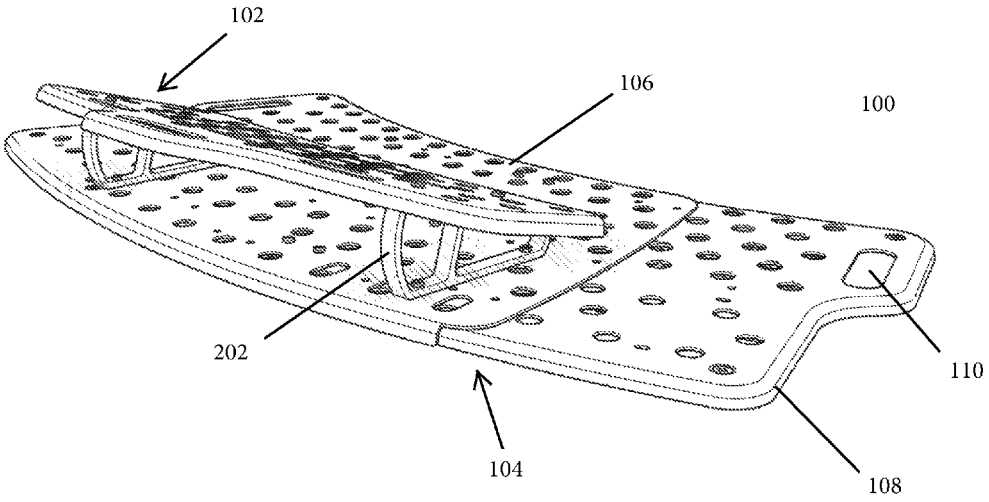
FIG. 9 is a back left side perspective view of the adjustable guitar effects pedalboard of FIG. 1 in a partially expanded configuration according to one embodiment of the disclosed device.

To attach the upper level 102 to the lower level 104, at least one riser 202 can be used. As mentioned above, in some embodiments, the riser 202 can attach to the bottom of the upper level 102 and the top face of the lower level 104 to provide a user with two levels of pedalboard options. Further, the riser 202 can move with the upper level 102 when a user decides to expand or contract the lower level 104, the process of which is described below in more detail. In some embodiments, the pedalboard 100 contains a plurality of risers 202, wherein one riser 202 is on the left side of the bottom face of the upper level 102 and one is on the right side of the bottom face of the upper level 102, as illustrated in FIGS. 6 and 9. However, any number of risers 202 can be used to lift and secure the upper level 102 on the top face of the lower level 104.

Figure 3:
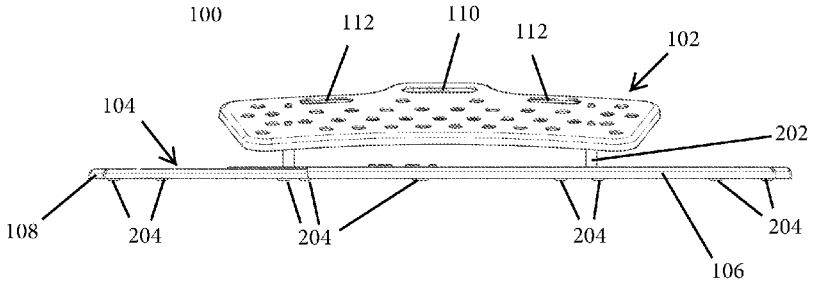
FIG. 3 is a front elevational view of the adjustable guitar effects pedalboard of FIG. 1 in a partially expanded configuration according to one embodiment of the disclosed device.
Figure 5:
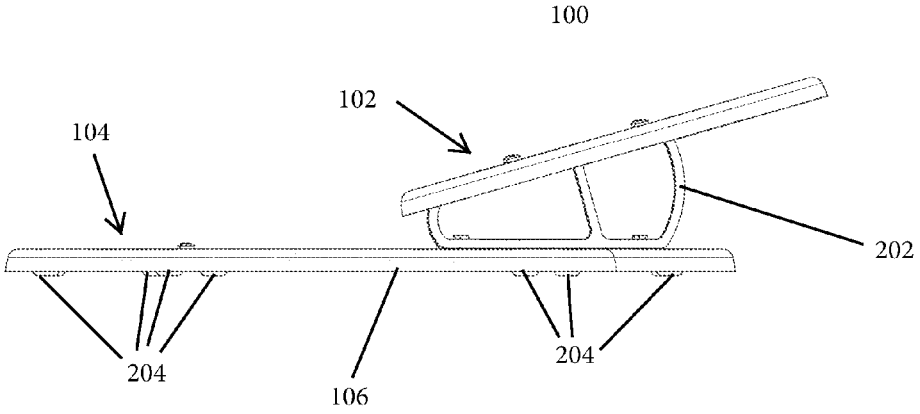
FIG. 5 is a right side elevational view of the adjustable guitar effects pedalboard of FIG. 1 in a partially expanded configuration according to one embodiment of the disclosed device.
Figure 7:
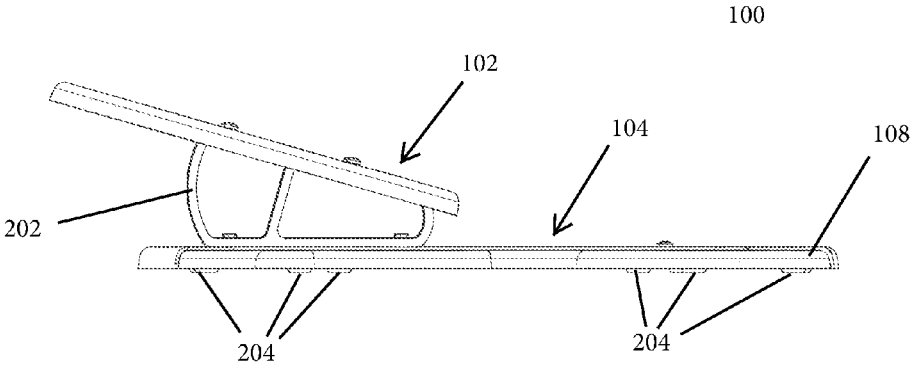
FIG. 7 is a left side elevational view of the adjustable guitar effects pedalboard of FIG. 1 in a partially expanded configuration according to one embodiment of the disclosed device.

In a preferred embodiment, the risers 202 lift the upper level 102 high enough off of the lower level 104 to allow effects pedals to fit underneath the upper level 102 on the portion of the lower level 104 situated underneath the upper level 102. The risers 202 can have a uniform height or they can be shorter in the front and taller in the back, as illustrated in FIGS. 5 and 7. By having the back of the risers 202 taller than the front, the upper level 102 tilts toward the user at an angle, as illustrated in FIG. 3, and permits a user to more effectively reach an effects pedal or an amp that is attached to the upper level 102. In some embodiments, the risers 202 are made of aluminum. However, they can be made of any solid material such as, but not limited to, wood, plastic, or any other metals.

Figure 2:
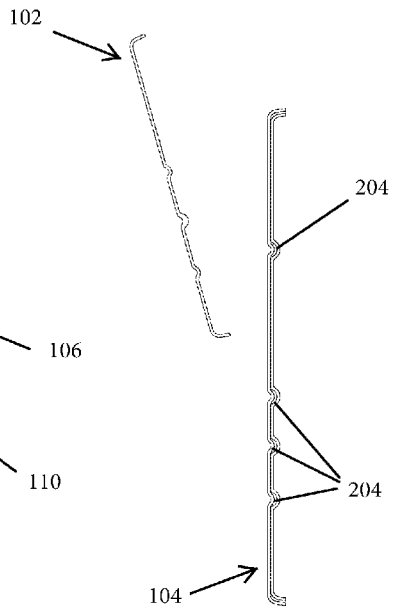
FIG. 2 is a right side cross-sectional view of the adjustable guitar effects pedalboard of FIG. 1 taken from the line 2-2 in FIG. 1.

In some embodiments, the main pieces or sections of the lower level 104 can contain feet 204 to hold the pedalboard 100 off of the ground and prevent the pedalboard 100 from slipping on smooth surfaces. Additionally, the extra space beneath the pedalboard 100 can be used to keep the pedalboard 100 stable and flat when cords and cable ties or other securing features are wrapped or routed underneath the pedalboard 100. As illustrated in FIG. 4, the feet 204 can be dispersed throughout the bottom face of the lower level 104. The feet 204 can be made of an elastomer such as natural rubber, a silicone rubber, or any other type of elastomeric compound. Alternatively, the feet 204 can be made of wood, plastic, or metal and can have attachments on their bottoms that provide a stronger friction coefficient. In another embodiment, the feet 204 may be incorporated into the pedalboard 100, as illustrated in FIG. 2. For example, if a mold is used to form the lower level 104, the mold can incorporate the feet 204 so that when the material is poured into the mold, the feet 204 are a continuous extension of the lower level 104. In an alternative embodiment, the feet 204 toward the back of the pedalboard 100 may be taller than the feet 204 toward the front of the pedalboard 100, or the feet 204 may be adjustable in height so a user can adjust each foot 204 according to the user's wishes. This enables the pedalboard 100 to tilt forward, which makes it easier for a user to reach the pedals attached to the top faces of the pedalboard 100. In some embodiments, instead of, or in addition to, feet 204, the pedalboard 100 can have a kickstand located underneath the lower level 104. The kickstand can lift the entire pedalboard 100 up uniformly, or it can enable the lower level 104 to tilt at an angle toward the user. The kickstand can also be adjustable to various heights.

In a preferred embodiment, the lower level 104 of the pedalboard 100 is comprised of two components or sections that create the telescoping feature, therefore enabling the width, illustrated along line W-W in FIG. 4, of the lower level 104 to vary. More specifically, each of the two sections has a relatively flat top face to enable guitar effects pedals to lay flush on top of the lower level 104. Additionally, the bottom face is flat to help the two components easily slide together and apart. In some embodiments, the lower level 104 may be comprised of more than two sections.

Of the two components, the first component is a first telescoping section 106 having a relatively flat, top face/mounting surface and a relatively flat, bottom face. It can be further comprised of a lip along its front, back, and right side, and a straight edge along its left side. Alternatively, in some embodiments, the first telescoping section 106 has a lip along its front, back, and left side and a straight edge along its right side. The second component is a second telescoping section 108 that can have a relatively flat, top face/mounting surface and a relatively flat, bottom face. It can be further comprised of a front and a back lip that match up to the lip along the front and back of the first telescoping section 106. Therefore, both the first telescoping section 106 and the second telescoping section 108 can include a lip along the front and back, as illustrated in FIG. 2. The second telescoping section 108 can also have a lip along its left side and a straight edge along its right side (for example, if the first telescoping section 106 has a lip along its right side), or it can have a lip along its right side and a straight edge along its left side (for example, if the first telescoping section 106 has a lip along its left side). This configuration enables the second telescoping section 108 to slide into and underneath the first telescoping section 106, creating various sizes of a lower level 104 to the pedalboard 100.

In another embodiment, the bottom face of the first telescoping section 106 has support tracks attached near and along the front and back of its bottom face. The second telescoping section 108 can fit in the length between the support tracks and slide along the tracks, and the support tracks can keep the second telescoping section 108 positioned appropriately to continue to allow the holes in the two components to line up with each other. Therefore, in this embodiment, the second telescoping section 108 may have a shorter length from front to back than the first telescoping section 106. However, the support tracks may be configured to allow the second telescoping section 108 to retain a similar length from front to back compared to the first telescoping section 106. In an embodiment of the pedalboard 100 having support tracks, the sides of the first telescoping section 106 and the second telescoping section 108 may or may not have lips.

Figure 10:
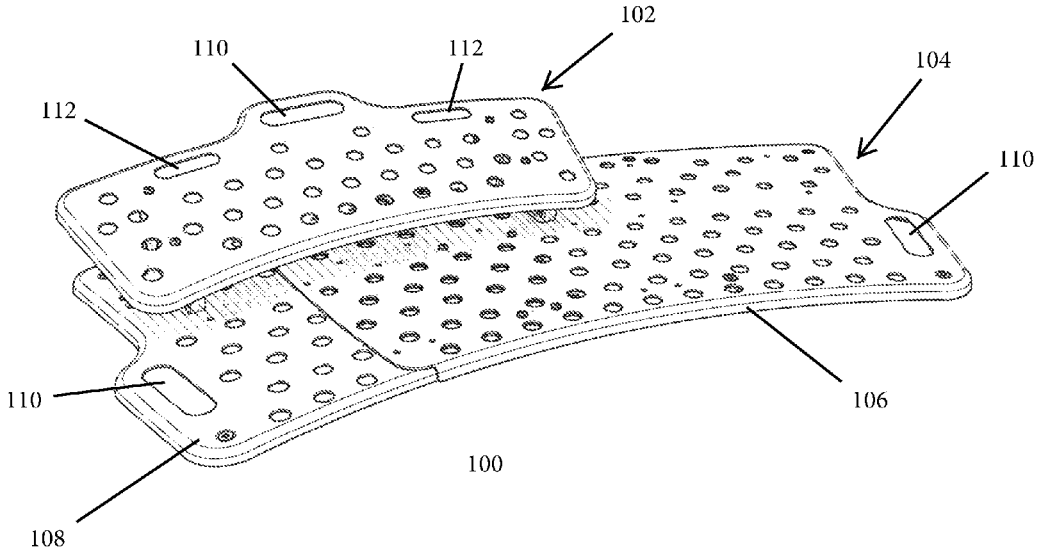
FIG. 10 is a front left side perspective view of an adjustable guitar effects pedalboard in a partially expanded configuration according to one embodiment of the disclosed device.
Figure 11:
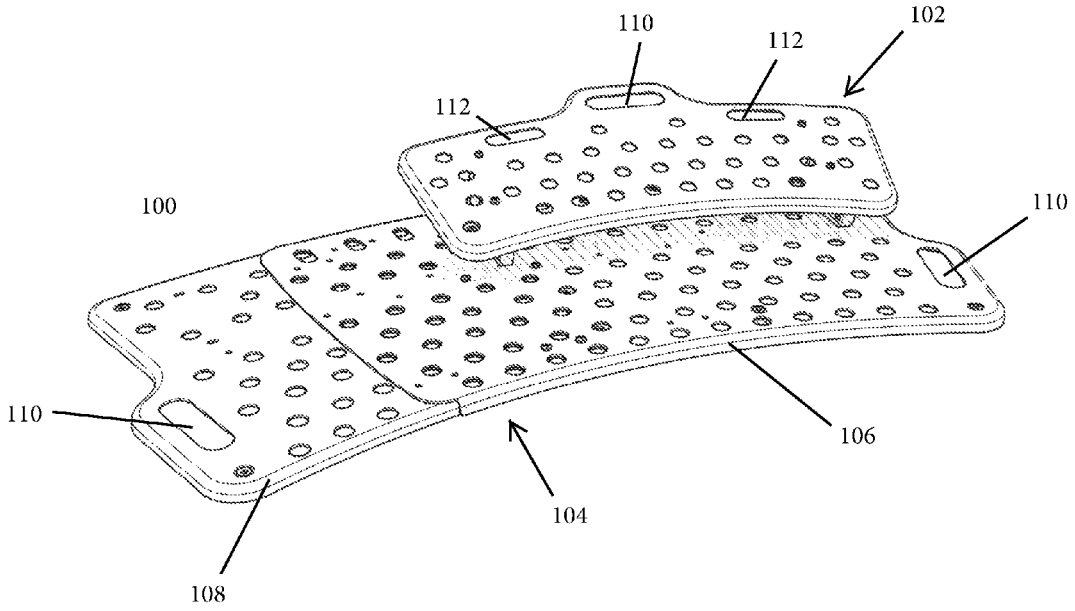
FIG. 11 is a front left side perspective view of an adjustable guitar effects pedalboard in a partially expanded configuration according to one embodiment of the disclosed device.
Figure 12:
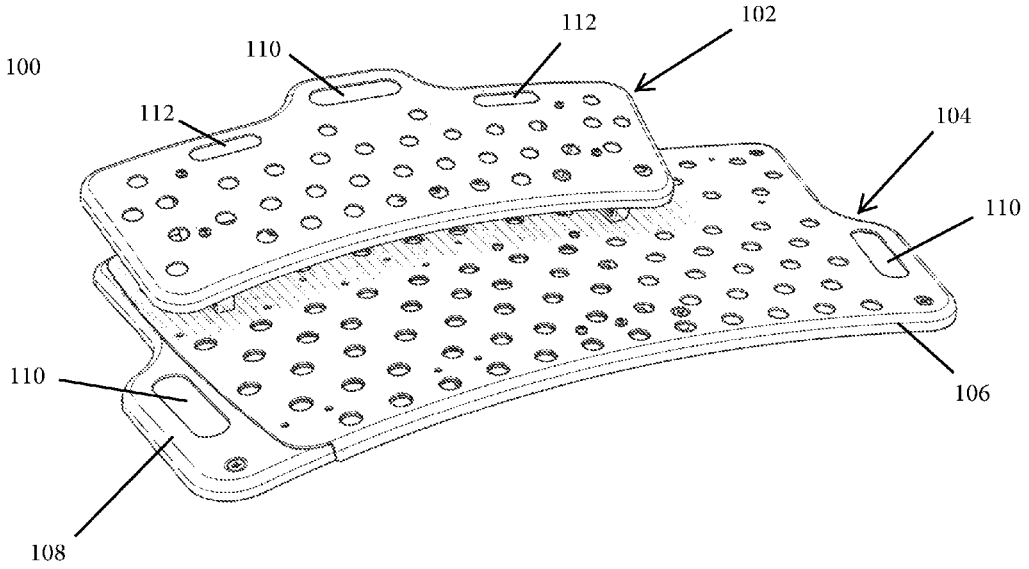
FIG. 12 is a front left side perspective view of the adjustable guitar effects pedalboard of FIG. 1 in a closed configuration according to one embodiment of the disclosed device.
Figure 13:
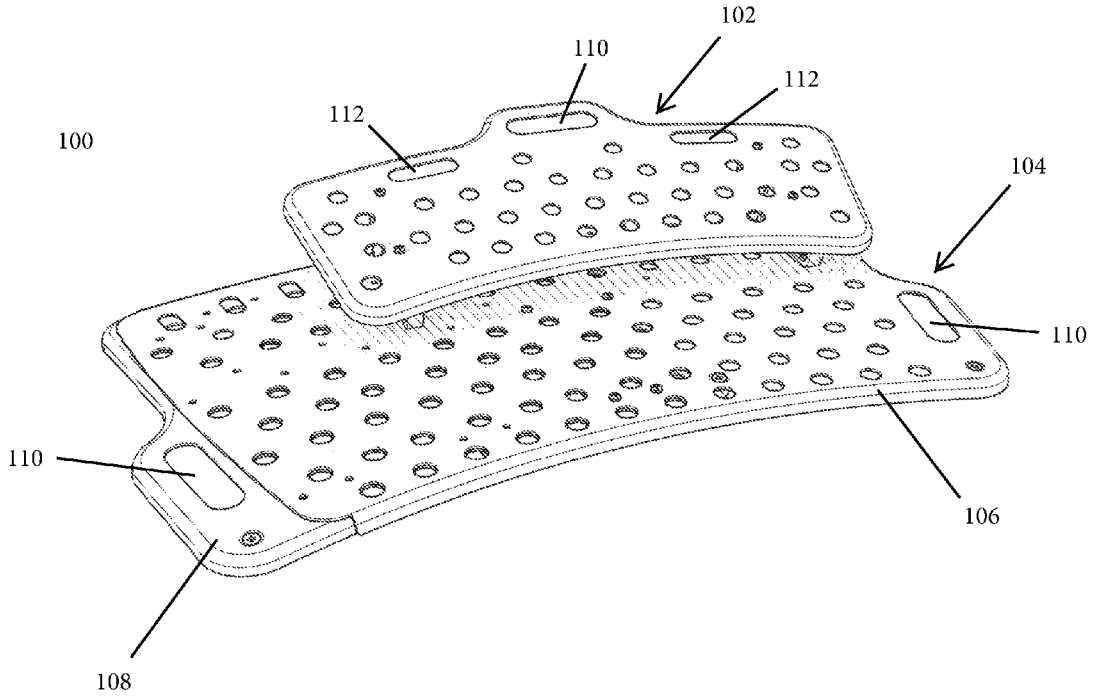
FIG. 13 is a front left side perspective view of the adjustable guitar effects pedalboard of FIG. 11 in a closed configuration according to one embodiment of the disclosed device.

In some embodiments, the lower level 104 can be configured and locked into three positions: a closed position, as illustrated in FIGS. 12-13, that can hold eight to ten guitar effects pedals; a partially-expanded position, as illustrated in FIGS. 1-11, that can hold ten to fifteen guitar effects pedals; and a fully expanded position, as illustrated in FIGS. 14-17, that can hold fifteen to twenty guitar effects pedals. Additionally, in some embodiments, the two components of the lower level 104 can be used separately. For example, a user can use the first telescoping section 106 on its own and, if the user decides he or she wants to add on the second telescoping section 108, the user can slide it into, and attach it to, the first telescoping section 106 and use the two components in combination. In some embodiments, the lower level 104 can expand to enable the pedalboard 100 to have a width between approximately 26 inches and 42 inches.

Similarly, the upper level 102, in some embodiments, can be separated from the lower level 104, and both levels can be used on their own. Because of this removability, the upper level 102 can also be attached via the risers 202 to various locations along the lower level 104. For example, one embodiment of the disclosed pedalboard 100 can create nine different configurations, wherein the pedalboard 100 has three width options for the lower level 104, as described above, and up to four positions for the upper level 102. More specifically, for the closed configuration of the lower level 104, the upper level 102 can fit into two positions, for the partially-expanded configuration of the lower level 104, the upper level 102 can fit into three positions, and for the fully expanded configuration of the lower level 104, the upper level 102 can fit into four positions.

Figure 8:
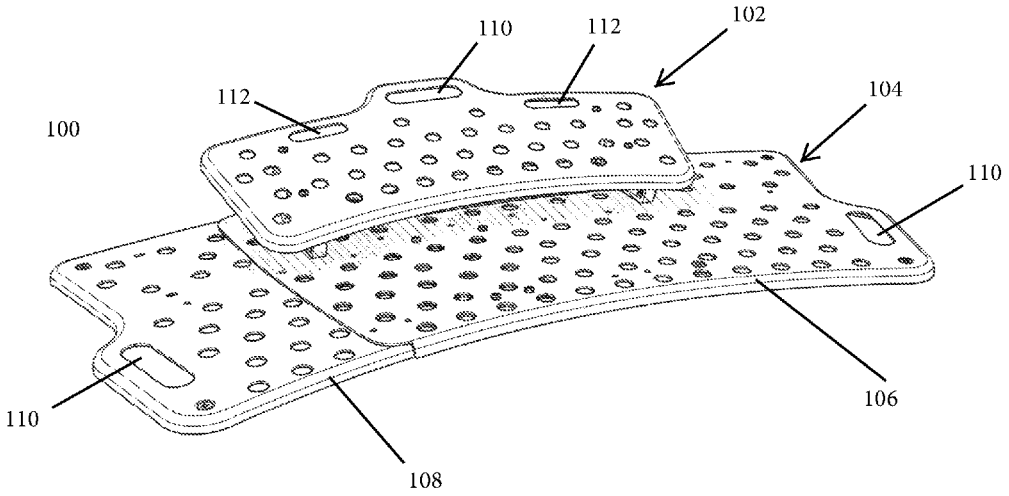
FIG. 8 is a front left side perspective view of the adjustable guitar effects pedalboard of FIG. 1 in a partially expanded configuration according to one embodiment of the disclosed device.
Figure 14:
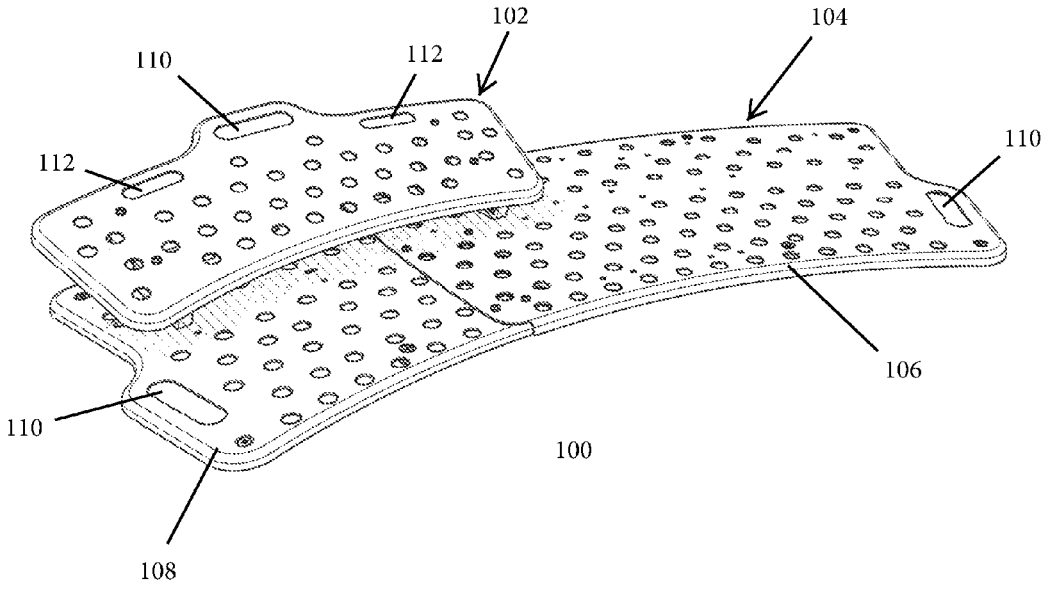
FIG. 14 is a front left side perspective view of an adjustable guitar effects pedalboard in a fully expanded configuration according to one embodiment of the disclosed device.
Figure 15:
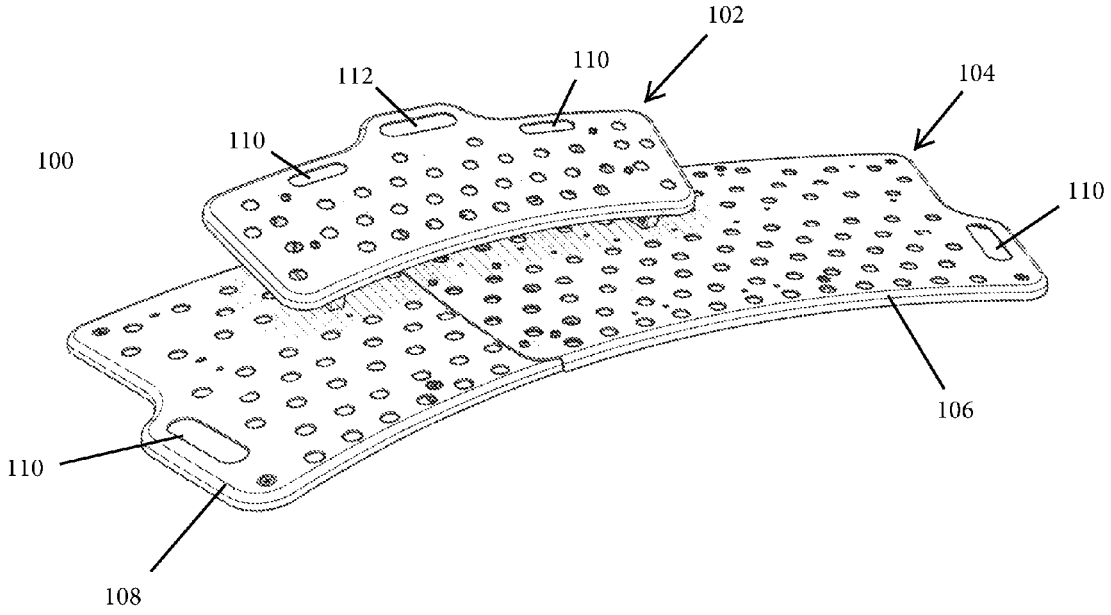
FIG. 15 is a front left side perspective view of the adjustable guitar effects pedalboard of FIG. 10 in a fully expanded configuration according to one embodiment of the disclosed device.
Figure 16:
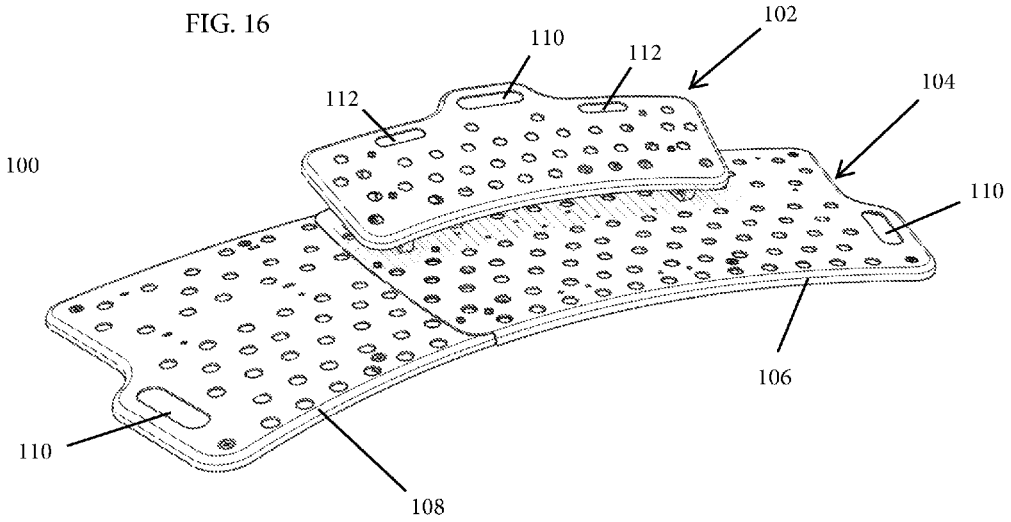
FIG. 16 is a front left side perspective view of the adjustable guitar effects pedalboard of FIG. 1 in a fully expanded configuration according to one embodiment of the disclosed device.
Figure 17:
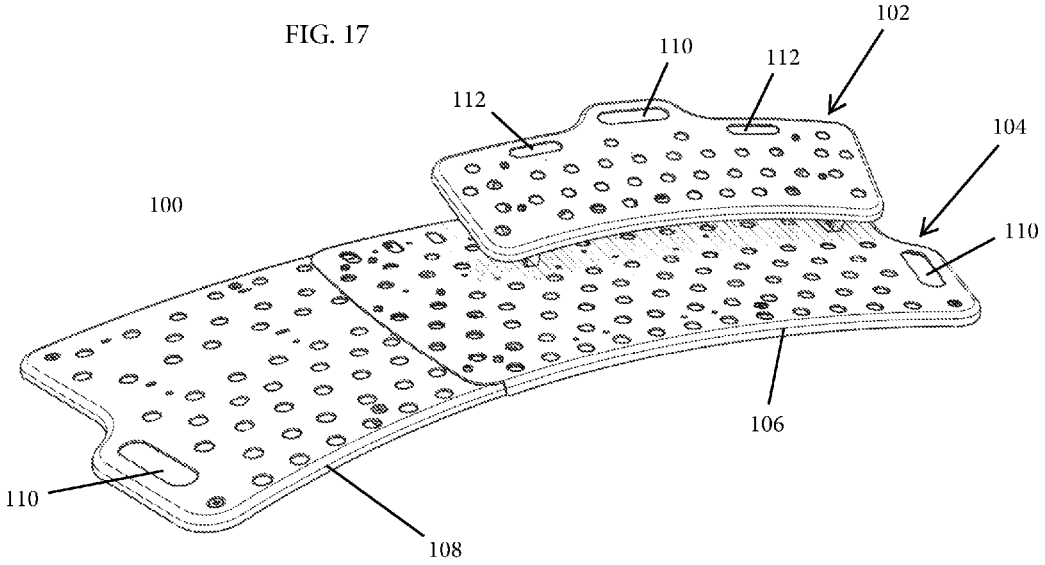
FIG. 17 is a front left side perspective view of the adjustable guitar effects pedalboard of FIG. 11 in a fully expanded configuration according to one embodiment of the disclosed device.

For example, FIG. 12 illustrates the pedalboard 100 in a closed configuration with the upper level 102 in the middle right position. FIG. 13 illustrates the pedalboard 100 in a closed configuration with the upper level 102 in the far right position. FIG. 10 illustrates the pedalboard 100 in a partially expanded configuration with the upper level 102 in the middle left position. FIG. 8 illustrates the pedalboard 100 in a partially expanded configuration with the upper level 102 in the middle right position. FIG. 11 illustrates the pedalboard 100 in a partially expanded configuration with the upper level 102 in the far right position. FIG. 14 illustrates the pedalboard 100 in the fully expanded configuration with the upper level 102 in the far left position. FIG. 15 illustrates the pedalboard 100 in the fully expanded configuration with the upper level 102 in the middle left position. FIG. 16 illustrates the pedalboard 100 in the fully expanded configuration with the upper level 102 in the middle right position. FIG. 16 illustrates the pedalboard 100 in the fully expanded configuration with the upper level 102 in the far right position.

As stated above, in a preferred embodiment, the lower level 104 has a telescoping feature that can increase or decrease the surface area to which the user can attach effects pedals by allowing at least two components to move along each other and overlock or interlock. More specifically, the second telescoping section 108 can slide along or into and out of the first telescoping section 106 to decrease and increase the width of the pedalboard 100. Therefore, there are several ways in which the lower level 104 can telescope, examples of which are described below.

In some embodiments, the mechanism by which the lower level 104 adjusts is a ratcheted locking mechanism. For example, the mechanism can be similar to a storm window, wherein the second telescoping section 108 can slide into a specific position, and a latch on the second telescoping section 108 can slide into a notch on the first telescoping section 106. To move the second telescoping section 108 out further or to pull it back in, the user can pull the latch out of the notch and simultaneously move the two pieces further apart or closer together.

In another embodiment, the two pieces may not have notches or latches and may instead slide fluidly across each other. In this embodiment, the first telescoping section 106 and the second telescoping section 108 can be secured in a relative position to each other using screws. For example, as illustrated in FIG. 18, screws can attach the upper level 102 to the risers 202 and can attach the risers 202 to the lower level 104. When the screws are tightened, the two pieces of the lower level 104, the first telescoping section 106 and the second telescoping section 108, can be secured in place. In some embodiments, there are screws for the expansion feature that operate independently from the screws attaching the risers 202 to the upper level 102 and the lower level 104. Therefore, a user can loosen the expansion screws and change the expansion configuration without unscrewing the risers 202 from the upper level 102 or the lower level 104. Similarly, a user can unscrew the risers' screws and move the risers 202 and the upper level 102 without affecting the expansion configuration of the lower level 104. In some embodiments, the first telescoping section 106 and the second telescoping section 108 may contain enough friction wherein a user can merely slide them together and apart and they will stay in place once moved into a desired position.

Importantly, regardless of which configuration the lower level 104 takes, at least some of the holes in the first telescoping section 106 can line up with at least some of the holes in the second telescoping section 108. This ensures that the solid areas on the second telescoping section 108 do not block the holes on the first telescoping section 106 and that the solid areas on the first telescoping section 106 do not block the holes on the second telescoping section 108. This alignment occurs even if the pedalboard 100 is curved and expands on an arc.

In addition to the holes used to secure effects pedals to the pedalboard 100, the pedalboard 100 can also contain larger, oblong holes located on the face of the pedalboard 100 to be used as handles 110 or as an easy way to hide straps or cords by enabling a person to thread the straps or cords through the holes and under the pedalboard 100. For example, FIG. 1 illustrates three handles 110 that make it easier for a user to carry the pedalboard 100, one near the back and in the center of the top face of the upper level 102, one on the lower left end of the top face of the lower level 104, and one on the lower right end of the top face of the lower level 104. The handles 110 can be located anywhere on the pedalboard 100, but are preferably on the top faces near the edges. Additionally, in some embodiments, the handles 110 may be protrusions from the pedalboard 100 instead of oblong holes located on the face of the pedalboard 100. In some embodiments, the upper level 102 also contains two cord holes 112 that a user can route cords through to keep them out of the user's way. These cord holes 112 can be any shape, such as oval, as illustrated in FIG. 1, circular, rectangular, square, or any other variety of shapes.

In an alternative embodiment, the top faces of the two telescoping components of the pedalboard 100 may, in a closed configuration, line up next to each other instead of overlapping with each other. Therefore, to expand the width of the pedalboard 100, a user can pull the two components away from each other creating space in between them. Within this space, there may be components such as bars, rails, or supports to which a user can directly attach guitar effects pedals. Alternatively, a third component, such as an insert, may fit in the space between the two telescoping components and attach to the bars, rails, or supports. In that case, guitar effects pedals may then attach to the insert.

In some embodiments, the pedalboard 100 can incorporate lights along the top face, bottom face, or any of the front, back, or side edges. The lights can be steady lights or can flash at regular or irregular intervals. In some embodiments, the lights can flash in time to the beat of the song the user is playing.

To carry the pedalboard 100, a matching bag or soft case may be used. The bag can resemble a messenger bag and can be adjustable in size to reflect the size of the user's pedalboard 100. For example, if a user has adjusted the pedalboard 100 to its smallest size, the user will not want the pedalboard 100 shifting around in the bag banging into additional items in the bag. Therefore, the user can shrink the size of the bag to create a snug fit. Alternatively, if the user has adjusted the pedalboard 100 to its biggest size, the user is going to need a bag that is big enough to fit the pedalboard 100 and can, thus, expand the bag to create the necessary space.

The mechanism used to change the size of the bag can, in some embodiments, be comprised of snaps and folding compartments. Therefore, to make the bag smaller, the user can fold a portion of the bag and snap it in place. Alternatively, straps could be used to hold the folded section in place. In another embodiment, the bag will not fold, but will have air pockets. Therefore, if a user needs to make the inside of the bag smaller, the user can put air into the pockets and the pockets will take up the extra space in the bag. If the user needs to make the bag bigger, the user can easily let air out.

Instead of using a bag, the pedalboard 100 may include a hinge in the middle and handles 110 on the outsides. Therefore, when a user needs to transport the pedalboard 100, the user can remove the pedals by releasing the securing mechanism (i.e., cutting the cable ties, rubber bands, twist ties, etc.), can fold up the board along the hinges, and can use the handles 110, which preferably align with each other when the pedalboard 100 is folded, to easily carry the pedalboard 100. In some embodiments, a locking mechanism may be included so the board does not unfold accidentally during transit.

What is claimed is:

1. A guitar effects pedalboard comprising:

a telescoping level with a substantially flat top mounting surface, a bottom surface, a front, a back, a left side, a right side; and a plurality of feet attached to the bottom of the telescoping level to hold the pedalboard off of the ground;

wherein:

the telescoping level is comprised of a first telescoping section and a second telescoping section that are connected; and the second telescoping section is configured to telescope underneath the first telescoping section.

2. The guitar effects pedalboard of claim 1, further comprising:

a removable, upper level located above the telescoping level, the removable, upper level having a substantially flat top mounting surface, a bottom surface, a front, a back, a left side, a right side, and a plurality of holes; and at least one riser securing the removable, upper level to the telescoping level;

wherein the riser connects to at least the top mounting surface of the telescoping level and the bottom surface of the removable, upper level.

3. The guitar effects pedalboard of claim 2, wherein:

the first telescoping section and the second telescoping section each have a plurality of holes; and in at least one orientation, at least one of the plurality of holes in the first telescoping section and at least one of the plurality of holes in the second telescoping section are configured to align with each other.

4. The guitar effects pedalboard of claim 3, wherein the plurality of holes in the removable, upper level, in the first telescoping section, and in the second telescoping section are circular.

5. The guitar effects pedalboard of claim 1, wherein the telescoping level is curved and expands on an arc.

6. The guitar effects pedalboard of claim 2, wherein the removable, upper level is curved.

7. The guitar effects pedalboard of claim 1, further comprised of a first support track near and along a front of the bottom surface of the first telescoping section, a second support track near and along a back of the bottom surface of the first telescoping section, and wherein the second telescoping section fits in a length between the first and the second support tracks.

8. The guitar effects pedalboard of claim 1, wherein the telescoping level includes a locking mechanism to lock the first telescoping section and the second telescoping section in place relative to each other.

9. The guitar effects pedalboard of claim 8, wherein the locking mechanism contains a plurality of locking positions.

10. The guitar effects pedalboard of claim 2, further comprised of at least one handle.

11. The guitar effects pedalboard of claim 10, wherein the at least one handle is a central handle located near the back of the removable, upper level.

12. The guitar effects pedalboard of claim 10, wherein the at least one handle is a first handle near the left side of the telescoping level and a second handle near the right side of the telescoping level.

13. The guitar effects pedalboard of claim 2, wherein the at least one riser has a front and a back, and the back of the at least one riser is taller than the front of the at least one riser.

14. The guitar effects pedalboard of claim 2, wherein the removable, upper level contains a plurality of oblong holes near the back of the removable, upper level.

15. The guitar effects pedalboard of claim 2, wherein the removable, upper level and the telescoping level are made of metal.

16. The guitar effects pedalboard of claim 2, wherein the removable, upper level is telescoping.

17. A guitar effects pedalboard comprising:

an upper level with a substantially flat top mounting surface, a bottom surface, a front, a back, a left side, a right side, and a plurality of holes;

a lower, telescoping level with a substantially flat top mounting surface, a bottom surface, a front, a back, a left side, a right side; and at least one riser securing the upper level to the lower, telescoping level;

wherein:

the lower, telescoping level is comprised of a first telescoping section and a second telescoping section;

the first telescoping section and the second telescoping section each have a plurality of holes;

in at least one orientation, at least one of the plurality of holes in the first telescoping section and at least one of the plurality of holes in the second telescoping section align with each other;

the second telescoping section is configured to telescope underneath the first telescoping section;

the lower, telescoping level is curved; and the riser connects to at least the top mounting surface of the lower, telescoping level and the bottom surface of the upper level.

18. The guitar effects pedalboard of claim 17, wherein the lower, telescoping level includes a locking mechanism to lock the first telescoping section and the second telescoping section in place relative to each other, and the locking mechanism contains a plurality of locking positions.

19. The guitar effects pedalboard of claim 17, further comprised of a kickstand located underneath the lower, telescoping level.

20. A guitar effects pedalboard comprising:

a removable, upper level with a substantially flat top mounting surface, a bottom surface, a front, a back, a left side, a right side, and a plurality of holes;

a lower, telescoping level with a substantially flat top mounting surface, a bottom surface, a front, a back, a left side, a right side; and at least one riser securing the removable, upper level to the lower, telescoping level;

wherein:

the lower, telescoping level is comprised of a first telescoping section and a second telescoping section;

the first telescoping section and the second telescoping section each have a plurality of holes;

in at least one orientation, at least one of the plurality of holes in the first telescoping section and at least one of the plurality of holes in the second telescoping section align with each other;

the plurality of holes in the removable, upper level are circular;

the plurality of holes in the first telescoping section and the second telescoping section are circular;

the second telescoping is configured to telescope underneath the first telescoping section;

the lower, telescoping level includes a locking mechanism to lock the first telescoping section and the second telescoping section in place relative to each other;

the locking mechanism contains a plurality of locking positions;

the removable, upper level is curved;

the removable, upper level contains a central handle near the back of the removable, upper level;

the lower, telescoping level is curved;

a plurality of feet are attached to the bottom surface of the lower, telescoping level;

the removable, upper level and the lower, telescoping level are made of metal;

the at least one riser connects to at least the top of the lower, telescoping level and the bottom surface of the removable, upper level;

the at least one riser has a front and a back; and the back of the riser is taller than the front of the riser.

* * * * *